United States Patent [19]

Kato et al.

[11] 4,242,432

[45] * Dec. 30, 1980

[54] PHOTOSENSITIVE MATERIAL FOR ELECTROPHOTOGRAPHY HAVING PHOTOSENSITIVE MULTI-LAYERS

[75] Inventors: Akira Kato; Akira Itoh; Tohru Uchida, all of Hachioji, Japan

[73] Assignee: Konishiroku Photo Industry Co., Ltd., Tokyo, Japan

[ * ] Notice: The portion of the term of this patent subsequent to Jan. 24, 1995, has been disclaimed.

[21] Appl. No.: 821,297

[22] Filed: Aug. 1, 1977

Related U.S. Application Data

[63] Continuation of Ser. No. 630,412, Nov. 10, 1975, Pat. No. 4,070,185.

[30] Foreign Application Priority Data

Nov. 22, 1974 [JP] Japan ..... 49/135295

[51] Int. Cl.[2] ..... G03G 5/08

[52] U.S. Cl. ..... 430/57; 430/84; 430/87; 430/94

[58] Field of Search ..... 96/1.5, 1 R, 1.8; 252/501; 430/57, 84, 87, 94

[56] References Cited

U.S. PATENT DOCUMENTS

| | | | |
|---|---|---|---|
| 2,844,734 | 7/1958 | Hartmann | 96/1.5 |
| 3,077,398 | 2/1963 | Jones | 96/1.8 |
| 3,350,610 | 10/1967 | Yamashita | 96/1.5 |
| 3,391,022 | 7/1968 | Saito | 96/1.5 |
| 3,679,405 | 7/1972 | Makino et al. | 96/1.5 |
| 3,704,121 | 11/1972 | Makino et al. | 96/1.5 |
| 3,801,317 | 4/1974 | Tanaka et al. | 96/1.5 |
| 4,070,185 | 1/1978 | Kato et al. | 96/1.5 |

FOREIGN PATENT DOCUMENTS

| | | | |
|---|---|---|---|
| 887021 | 11/1971 | Canada | 96/1.5 |
| 44-12384 | 6/1969 | Japan | 96/1.5 |
| 44-12388 | 6/1969 | Japan | 96/1.5 |
| 999405 | 7/1965 | United Kingdom | 96/1.5 |

*Primary Examiner*—J. Travis Brown

*Attorney, Agent, or Firm*—Lane, Aitken, Ziems, Kice & Kananen

[57] ABSTRACT

A photosensitive material for electrophotography which comprises a conductive support and two or more superimposed photosensitive layers where each layer comprises photoconductive powder and a binder, the particle size of the photoconductive powder in an upper layer being greater than that in a lower layer. Both high photosensitivity and high resistance to electrical impact are imparted to the photosensitive material.

4 Claims, No Drawings

PHOTOSENSITIVE MATERIAL FOR ELECTROPHOTOGRAPHY HAVING PHOTOSENSITIVE MULTI-LAYERS

This is a continuation of application Ser. No. 630,412, filed Nov. 10, 1975, now U.S. Pat. No. 4,070,185, issued on Jan. 24, 1978.

BACKGROUND OF THE INVENTION

This invention relates to a photosensitive material for electrophotography which may be repeatedly used.

In electrophotography, there are known a method wherein an electrostatic latent image is first formed on a photosensitive layer and is developed by a developer to form a toner image, and the toner image is then fixed on the photosensitive layer, and a method wherein a toner image is formed on a photosensitive layer and thus formed toner image is transferred to a transfer material for fixing. In the latter method involving the transference of a toner image, two kinds of photosensitive materials or elements are generally used, one using a vacuum evaporation film of selenium as a photosensitive layer and the other using a photosensitive layer where photoconductive powders such as zinc oxide or cadmium sulfide is dispersed in a binder of a polymeric material with high insulating property. (The latter will be hereinafter referred to as a binder-type photosensitive material for electrophotography.) In recent years, the binder-type photosensitive materials predominate over selenium photosensitive materials in a repeated transfer-type electrophotography (e.g., xerography) in which toner image is repeatedly transferred at every cycle of reproduction operations. However, the binder-type photosensitive materials are generally lower in photosensitivity than the selenium photosensitive materials. In order to enhance the photosensitivity, it is essential to use photoconductive powder with a relatively large particle size. The use of photoconductive powder with a large particle size is, however, disadvantageous in that the resulting photosensitive material or element is unsatisfactory in electric characteristics and is incable of producing an image with high quality. Especially, when such photosensitive material is applied in the repeated transfer-type electrophotography, it is impossible to effect continuous reproduction operations due to fatigue phenomenon.

For providing a binder-type photosensitive material having on its surface a photosensitive layer which has great mechanical strengths or durability, there is known a method wherein a plurality of photosensitive layers is provided on a support. The Japanese Patent Publication Nos. 8431/1969 and 33794/1974 describe photosensitive materials where two photosensitive layers are superimposed on a support, in order to improve durability of photosensitive layer. In these photosensitive materials, the upper layer has a greater ratio of binder resin to photoconductive powder than the lower layer and a resin with great mechanical strengths or durability is used as a binder for the upper layer. While these binder-type photosensitive materials serve to improve durability to some extent, they fail to improve photosensitivity at all.

BRIEF SUMMARY OF THE INVENTION

It is therefor an object of the present invention to provide a photosensitive material for electrophotography which has both high photosensitivity and durability.

It is another object of the present invention to provide a photosensitive material for electrophotography which can continuously reproduce images with high quality even when employed over a long period of time in the repeated transfer-type electrophotography.

DETAILED DESCRIPTION OF THE INVENTION

According to the present invention, there is provided a photosensitive material for electrophotography which comprises a conductive support and at least two superimposed photosensitive layer where each layers comprises photoconductive powder and a resin binder. A particle size of the photoconductive powder in an upper layer of the photosensitive material is greater than that of a lower layer so that the upper layer is made high in coefficiency of absorption of light and accordingly displays high photosensitive characteristics, while the lower layer can withstand an electrical impact caused by corona discharge and accordingly increases durability of the photosensitive layer as a whole and makes quality of reproduced images high. Thus, the upper layer has high photosensitivity and the lower layer exhibits excellent durability without producing any indistinctness or coarseness in reproduced image when the photosensitive element of the invention is applied to the repeated transfer-type electrophotographic system.

The conductive supports useful in the present invention are, for example, plastic films such as of polyethylene, polyester, etc., or paper sheets one surface of which has been vacuum-evaporated or laminated with aluminum in the form of a thin layer or which has been coated with a carbon-resin dispersion and dried, and paper sheets impregnated with metal salts or ammonium quaternary salts of organic compounds. If necessary, an undercoating such as of casein, gelatin, ethyl cellulose, starch, polyvinyl acetate or polyvinylbutyral may be formed on the conductive support.

Examples of the photoconductive powder suitable for the present invention include inorganic photoconductive powders such as of zinc oxide, zinc sulfide, cadmium sulfide, cadmium selenide and titanium dioxide. The binder resin to be a dispersion medium of the photoconductive powder includes, for example, a polymer or copolymer of styrene, butadiene, vinyl acetal, vinyl ether, vinylidene chloride, vinyl chloride, vinyl acetate, acrylic acid esters or methacrylic acid esters, nitrocellulose, ethyl cellulose, cellulose acetate, silicon resin, urea resin, melamine resin, epoxy resin, phenol resin or alkyd resin. Besides, natural resins may be also employed. In this connection, however, the binder resin to be used in the top layer is preferred to be a thermosetting resin.

The photosensitive electrophotographic material of the invention can be prepared as follows. There is first provided, for example, a polyester film, on which are formed an aluminum thin layer and then an undercoating layer such as casein in a thickness of 0.1–5$\mu$ to obtain a conductive support. While, a photosensitive dispersion is prepared by dispersing photoconductive powder with an average particle size below 0.5$\mu$, a resin binder, and, if required, a sensitizing dye in an organic solvent by means of a ball mill or other suitable dispersing means for several hours. The binder resin is generally used in an amount of 5–50 parts by weight, preferably 10–30 parts by weight, per 100 parts by weight of the photoconductive powder. Examples of the organic solvent are toluene, benzene, xylene, ethyl acetate, acetone, methyl ethyl ketone and methyl alcohol and these solvents are used in an amount of 50–300 ml per 100 parts by weight of the photoconductive powder. Examples of the sensitizing dye include Rose Bengale, Bromothymol Blue, Bromocresol Blue, Bromophenol Blue and the like. These sensitizing dyes are generally used in the form of a 2% solution in ethyl alcohol or other suitable solvent and in an amount of 1–15 ml of the solution (i.e., 0.02 g–0.3 g when expressed on solid basis) per 100 parts by weight of the photoconductive powder. The thus obtained photosensitive dispersion was applied onto the conductive support by an ordinary coating method including a wire bar, dipping, gravure or spraying method in such a manner that a dry thickness is in the range of 5–30μ, followed by drying in a hot air of 30°–130° C. for 1–30 min and, if required, thermally treating at 50°–150° C. for 30 min—5 hours thereby to form a lower photosensitive layer on the conductive support.

Then, another photosensitive dispersion including photoconductive powder of zinc oxide, cadmium sulfide or the like, a binder resin, an organic solvent and a sensitizing dye is prepared. In this case, however, the average particle size of the photoconductive material is generally above 0.5μ, preferably in the range of 0.5–3μ. The photosensitive dispersion is similarly applied onto the lower layer to form an upper photosensitive layer. Upon formation of the upper layer, the same or different kind and amount of binder resin, organic solvent and sensitizing dye, dispersing and coating methods, drying and thermal treatments, and dry thickness as those for the lower layer may be employed.

In the present invention, there may be further provided between the upper and lower photosensitive layers an intermediate layer which includes a photoconductive material such as zinc oxide or cadmium sulfide with an average particle size intermediate therebetween. Thus, the photosensitive layer of the invention is composed of two or more layers which contain different particle sizes of photoconductive powder or powders from each other. In these cases, a particle size of an upper layer is always greater than that of a lower layer. The kinds of inorganic photoconductive powder to be used in each of the photosensitive layers may the same or different.

Further, the photosensitive layer may be composed of one layer in which the particle size of photoconductive powder is made continuously greater in the direction of an upper surface.

The present invention will be particularly illustrated by way of the following examples, which should not be construed as limiting thereto the present invention.

EXAMPLE 1

A polyester film was laminated with an aluminum thin film, onto which was applied a casein aqueous solution in such a way that the casein dry thickness reached 2μ. Then, a photosensitive dispersion of the following formulation which was obtained by a dispersion treatment in a ball mill for 5 hours was coated onto the casein layer by the use of a wire bar in such a way that a dry thickness of the resultant photosensitive layer was 17μ, followed by drying in a hot air of 70° C. for 10 min and then thermally treating in a dryer of 70° C. for 3 hours to form a lower photosensitive layer.

| Formulation of photosensitive dispersion | |
|---|---|
| zinc oxide with an average particle size of 0.3 μ | 100 g |
| thermosetting acrylic resin (50% xylene solution) | 40 ml (20 g of solid matter) |
| melamine resin 50% n-butanol and xylene solution) | 10 ml (5 g of solid matter) |
| 2% Rose Bengale solution in methanol | 15 ml |
| toluene | 150 ml |

Then, another photosensitive dispersion of the following formulation which was obtained by dispersion in a ball mill for 5 hours was applied onto the first photosensitive layer by a gravure method in such a way that a dry thickness was 5μ, followed by drying in a hot air of 70° C. for 10 min and then thermally treating in a dryer of 70° C. for 3 hours to form an upper photosensitive layer.

| Formulation | |
|---|---|
| zinc oxide with an average particle size of 0.7 μ | 100 g |
| thermosetting acrylic resin (50% solution in xylene) | 30 ml (15 g of solid matter) |
| melamine resin 50% solution in n-butanol and xylene) | 6 ml (3 g of solid matter) |
| 2% Rose Bengale solution in methanol | 15 ml |
| toluene | 150 ml |

Thus, the two-photosensitive-layers element was made (sample No. 6). Thereafter, the above process was repeated, without change of the dry thicknesses of the respective photosensitive layers, except that kinds and particle sizes of photoconductive powder and kind of binder resins were changed as shown in Table 1 and that a 50% 1:1 alkyd resin and silicon resin solution in toluene was used when a thermoplastic resin was employed as a binder, thereby to obtain three comparative samples (sample Nos. 1, 2 and 3) and five samples of the invention (sample Nos. 7–11). The thus obtained samples of the invention and comparative samples were each placed in position in a repeated transfer-type electro duplicator Model U-BIX-800 (produced by Konishiroku Photo Co., Ltd). For each sample, the reproduction was continuously effected 1000 times to determine charging potentials of photosensitive layer of each of the samples obtained prior to use and after the 1000th reproduction by means of a rotary electrometer and also to determine both proper lens apertures of the duplicators at the time when the first and 1000th reproduction operations were, respectively, effected for each sample and qualities or densities of the images reproduced at the first and 1000th reproductions.

The test results are shown in Table shown below.

The initial potential indicated in Table 2 is a surface potential which was determined by placing a sample obtained after the first or 1000th reproduction in a rotary electrometer for charging up to its saturation potential by means of a corona discharger and the surface potential was measured 5 seconds after the charging. The rated value of proper lens aperture intends to mean an optimum lens aperture obtained at the time when a sample mounted in the duplicator was subjected to the first or 1000th reproduction, the value ranging from 1 to 5. The greater the value, the smaller is the exposure. The degree of distinctness of reproduced image was determined by visual observations: a coarsely indistinct image was rated as poor, an image with an appreciable amount of coarseness was considered as fair, and a distinct and clear image was rated as excellent.

EXAMPLE 2

In this example, three distinct photosensitive layers were formed on the conductive support of Example 1 to make a three-photosensitive-layers material of the invention. The lower photosensitive layer was formed in the same manner as in Example 1 except that the zinc oxide powder used had an average particle size of 0.2μ and its dry thickness was 12μ. The intermediate layer was formed on the lower layer in the same manner as the lower layer of Example 1 except that zinc oxide had an average particle size of 0.4μ, the thermosetting acrylic resin and melamine resin were employed in amounts of 18 g and 3 g, respectively, and a dry thickness of the layer was 6μ. Further, the upper layer was formed in the same manner as in Example 1 using zinc oxide with an average particle size of 1.0μ. The resultant three-photosensitive-layers material was subjected to tests as indicated in Example 1 (sample No. 12).

EXAMPLE 3

A photosensitive layer was formed on the same kind of a conductive layer as used in Example 1 in the same manner as the first or lower layer of Example 1 except that zinc oxide had an average particle size of 0.2μ, the thermosetting acrylic resin and melamine resin were used in amounts of 17 g and 3 g, respectively, and a dry thickness of the layer was 20μ, thereby to obtain an one-photosensitive-layer material for comparative purpose (sample No. 4).

The above process was repeated using zinc oxide with an average particle size of 0.8μ to obtain another one-photosensitive-layer element as a comparative sample (sample No. 5).

The thus obtained comparative samples (samples Nos. 4 and 5) were subjected to tests in the same manner as in Example 1. The test results are shown in Table below.

Table

| Sample No. | kind and amount of material employed and characteristics | photoconductive powder 100g: particle size of lower layer μ | particle size of upper layer μ | binder resin: amount and kind in lower layer g | amount and kind in upper layer g | initial potential: prior to use | after 1000th reproduction |
|---|---|---|---|---|---|---|---|
| Comparative Sample | 1 | ZnO 0.8 | ZnO 0.8 | thermosetting resin 25 | thermosetting resin 18 | 300 | 220 |
| | 2 | ZnO 1.5 | ZnO 0.2 | thermosetting resin 25 | thermosetting resin 18 | 340 | 300 |
| | 3 | ZnO 0.2 | ZnO 0.2 | thermosetting resin 25 | thermosetting resin 18 | 340 | 300 |
| | 4 | ZnO 0.2 | — | thermosetting resin 20 | — | 340 | 300 |
| | 5 | ZnO 0.8 | — | thermosetting resin 20 | — | 300 | 200 |
| Sample | 6 | ZnO 0.1 | ZnO 0.7 | thermosetting resin 25 | thermosetting resin 18 | 320 | 300 |
| | 7 | ZnO 0.4 | ZnO 0.8 | thermosetting resin 25 | thermosetting resin 18 | 320 | 300 |
| | 8 | ZnO 0.3 | ZnO 2.0 | thermosetting resin 25 | thermosetting resin 18 | 290 | 270 |
| | 9 | ZnO 0.2 | ZnO 0.8 | thermosetting resin 25 | thermosetting resin 18 | 330 | 300 |
| | 10 | CdS 0.2 | ZnO 1.5 | thermosetting resin 25 | thermosetting resin 18 | 300 | 280 |
| | 11 | CdS 0.2 | CdS 1.5 | thermosetting resin 25 | thermosetting resin 18 | 400 | 360 |
| | | lower layer | intermediate | upper layer | lower layer | intermediate | upper layer |

Table -continued

| 12 | ZnO 0.2 | layer ZnO 0.4 | ZnO 1.0 | layer thermosetting resin 25 | 21 | 18 | 380 | 340 |
|---|---|---|---|---|---|---|---|---|

| Sample No. | kind and amount of material employed and characteristics | proper lens aperture: at first reproduction | proper lens aperture: at 1000th reproduction | image density: first reproduction | image density: 1000th reproduction | distinctness of reproduced image: first reproduction | distinctness of reproduced image: 1000th reproduction |
|---|---|---|---|---|---|---|---|
| Comparative Sample | 1 | 3.5 | 3.5 | 1.0 | 0.4 | fair | poor |
| | 2 | 2.0 | 2.0 | 1.4 | 1.2 | excellent | excellent |
| | 3 | 1.5 | 1.5 | 1.4 | 1.3 | excellent | excellent |
| | 4 | 1.5 | 1.5 | 1.4 | 1.3 | excellent | excellent |
| | 5 | 3.5 | 3.5 | 1.0 | 0.3 | fair | poor |
| Sample | 6 | 3.0 | 3.0 | 1.2 | 1.0 | excellent | excellent |
| | 7 | 3.5 | 4.0 | 1.3 | 1.1 | excellent | excellent |
| | 8 | 4.0 | 4.5 | 1.0 | 0.9 | excellent | excellent |
| | 9 | 3.5 | 3.5 | 1.3 | 1.2 | excellent | excellent |
| | 10 | 4.0 | 4.0 | 1.2 | 1.0 | excellent | excellent |
| | 11 | 4.0 | 4.0 | 1.4 | 1.2 | excellent | excellent |
| | 12 | 4.2 | 4.2 | 1.2 | 1.2 | excellent | excellent |

As will be clear from the Table, the samples of the invention are superior in photosensitivity, distinctness of image, and durability to the comparative samples when compared with each other under the same continuous repeated reproduction conditions.

We claim:

1. A photosensitive article for electrophotography having a conductive substrate and a coating of photosensitive material comprising photoconductive powder in a binder, said coating comprising at least two superimposed photosensitive layers wherein each layer contains photoconductive powder in a binder, the particle size of said photoconductive powder in the layer adjacent to the substrate being smaller than 0.5 microns and the particle size of the photoconductive powder in the superimposed outer layer being in the range of 0.5 microns to 3 microns.

2. The photosensitive article of claim 1 wherein the photoconductive powder in said photosensitive layers are members selected from the group consisting of zinc oxide, zinc sulfide, cadmium sulfide, cadmium selenide and titanium dioxide.

3. The photosensitive article of claim 1 wherein said binder is contained in each layer of the range of 5–50 parts by weight per 100 parts by weight of said photoconductive powder.

4. The photosensitive article of claim 1 wherein each of said photosensitive layers has a thickness of 5–30$\mu$.

* * * * *